US009744543B1

(12) United States Patent
Monaghan

(10) Patent No.: US 9,744,543 B1
(45) Date of Patent: Aug. 29, 2017

(54) APPARATUS AND METHOD FOR DISPERSING A CHEMICAL AGENT

(71) Applicant: GELCO Supply, Inc., Salem, OR (US)

(72) Inventor: James D. Monaghan, Salem, OR (US)

(73) Assignee: GELCO Supply, Inc., Salem, OR (US)

( * ) Notice: Subject to any disclaimer, the term of this patent is extended or adjusted under 35 U.S.C. 154(b) by 742 days.

(21) Appl. No.: 14/027,993

(22) Filed: Sep. 16, 2013

Related U.S. Application Data

(62) Division of application No. 12/704,246, filed on Feb. 11, 2010, now Pat. No. 8,535,757.

(51) Int. Cl.
*B05B 3/02* (2006.01)
*B05B 7/04* (2006.01)
*B05B 7/26* (2006.01)

(52) U.S. Cl.
CPC ..... *B05B 7/0408* (2013.01); *B05B 7/26* (2013.01)

(58) Field of Classification Search
CPC ..... B05B 7/0408; B05B 7/26
USPC ..... 239/162, 381, 383; 134/24, 36, 168
See application file for complete search history.

(56) References Cited

U.S. PATENT DOCUMENTS 2,650,860 A * 9/1953 Carr ..... B05B 1/3426 239/468
2,710,980 A * 6/1955 Pletcher ..... B05B 3/0427 15/104.12
3,165,109 A * 1/1965 Hammelmann ..... E03F 9/00 134/167 C
4,315,600 A * 2/1982 Rhoades ..... A01C 23/042 137/564.5
4,981,524 A * 1/1991 Waite ..... B05B 3/08 134/167 C
5,409,561 A * 4/1995 Wood ..... F16L 55/1645 138/97
5,735,955 A * 4/1998 Monaghan ..... E03F 9/00 118/317
6,820,824 B1 * 11/2004 Joseph ..... B05B 7/2408 239/302
2003/0172871 A1 9/2003 Scherer

* cited by examiner

*Primary Examiner* — Arhur O Hall
*Assistant Examiner* — Joel Zhou
(74) *Attorney, Agent, or Firm* — Suiter Swantz pc llo

(57) ABSTRACT

An apparatus includes an intake assembly, the intake assembly including a connector, the connector configured for coupling to a pressurized liquid source. The apparatus also includes a chemical storage assembly. The chemical storage assembly is coupled to at least one outlet of the intake assembly. The chemical storage assembly is configured for at least one of (a) storing a chemical or (b) mixing a chemical with a liquid from the pressurized liquid source. The apparatus further includes an outlet assembly. The outlet assembly includes a first outlet configured for expelling pressurized liquid from the pressurized liquid source in a first direction at a rate sufficient to induce approximately lateral movement of the apparatus. The outlet assembly also includes a second outlet configured for expelling at least one of the chemical or the chemical mixed with the liquid.

18 Claims, 16 Drawing Sheets

APPARATUS AND METHOD FOR DISPERSING A CHEMICAL AGENT

CROSS-REFERENCE TO RELATED APPLICATIONS

The present application claims the benefit under 35 U.S.C. §121 of U.S. patent application Ser. No. 12/704,246, filed Feb. 11, 2010.

FIELD

The present disclosure generally relates to the field of chemical agent dispensation, and more particularly to a fluid-propelled apparatus and method for applying a chemical agent within an enclosed environment.

BACKGROUND

An enclosed environment, such as a sewer line or drainage pipe system, may require maintenance in order to function effectively. For instance, vegetation located near the enclosed environment may penetrate the enclosed environment with roots, which may cause partial or even total blockage of flow through the enclosed environment. Treatment may include physical removal of blockages and chemical dispensation within the enclosed environment, such as to remove existing blockages and/or prevent potential blockages from forming.

SUMMARY

An apparatus includes an intake assembly, the intake assembly including a connector, the connector configured for coupling to a pressurized liquid source. The pressurized liquid source supplies a pressurized liquid to the intake assembly. The apparatus also includes a chemical storage assembly. The chemical storage assembly is coupled to at least one outlet of the intake assembly. The chemical storage assembly is configured for at least one of (a) storing a chemical or (b) mixing a chemical with a liquid from the pressurized liquid source. The apparatus further includes an outlet assembly. The outlet assembly includes a first outlet configured for expelling pressurized liquid from the pressurized liquid source in a first direction at a rate sufficient to induce approximately lateral movement of the apparatus. The outlet assembly also includes a second outlet configured for expelling at least one of the chemical or the chemical mixed with the liquid.

A method includes loading a chemical agent into a spray apparatus. The method also includes inserting the spray apparatus into a generally cylindrical environment. The method further includes propelling with pressurized fluid the spray apparatus in a generally longitudinal direction along the generally cylindrical environment. The method additionally includes mixing the chemical agent with fluid from a pressurized fluid source. The method still further includes dispersing the mixed chemical agent and fluid from the spray apparatus while retrieving the spray apparatus in a direction opposite the generally longitudinal direction along the generally cylindrical environment.

A system includes a pressurized liquid source and a spray apparatus configured for placement in an enclosed environment. The spray apparatus includes an intake assembly, the intake assembly including a connector, the connector configured for coupling to a pressurized liquid source. The pressurized liquid source supplies a pressurized liquid to the intake assembly. The spray apparatus also includes a chemical storage assembly. The chemical storage assembly is coupled to at least one outlet of the intake assembly. The chemical storage assembly is configured for at least one of (a) storing a chemical or (b) mixing a chemical with a liquid from the pressurized liquid source. The spray apparatus further includes an outlet assembly. The outlet assembly includes a first outlet configured for expelling pressurized liquid from the pressurized liquid source in a first direction at a rate sufficient to induce approximately longitudinal movement of the apparatus through the enclosed environment. The outlet assembly also includes a second outlet configured for expelling at least one of the chemical or the chemical mixed with the liquid.

It is to be understood that both the foregoing general description and the following detailed description are exemplary and explanatory only and are not necessarily restrictive of the disclosure as claimed. The accompanying drawings, which are incorporated in and constitute a part of the specification, illustrate an embodiment of the disclosure and together with the general description, serve to explain the principles of the disclosure.

BRIEF DESCRIPTION OF THE DRAWINGS

The numerous advantages of the present disclosure may be better understood by those skilled in the art by reference to the accompanying figures in which.

DETAILED DESCRIPTION

Reference will now be made in detail to the presently preferred embodiments of the present disclosure, examples of which are illustrated in the accompanying drawings.

Figure 1:
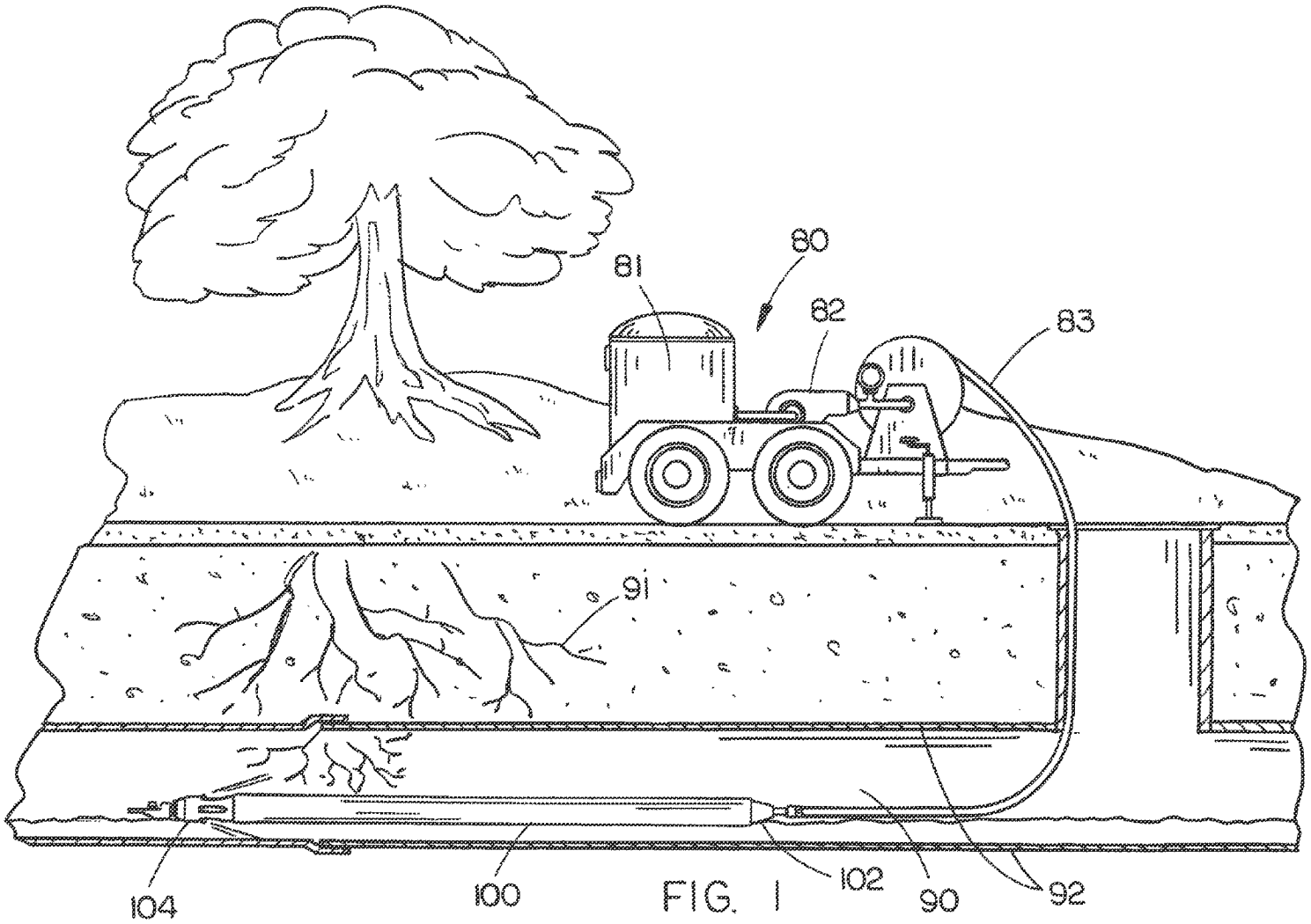
FIG. 1 is a sectional elevation view of an enclosed environment through which an embodiment of a fluid-propelled apparatus of the present disclosure travels.

Referring now to FIG. 1, a sectional elevation view of an enclosed environment 90 through which an embodiment of a fluid-propelled apparatus 100 of the present disclosure is shown. Enclosed environment 90 may be a sewer line, a drainage pipe, or other enclosure with relatively limited access that may require maintenance to function effectively. For example, in the embodiment depicted in FIG. 1, enclosed environment 90 is a sewer line, into which floral infestations 91 (e.g., roots from a nearby tree) may grow. The floral infestations 91 may breach the enclosed environment to a degree which may impede or block flow of a fluid traveling through the enclosed environment 90. Apparatus 100 may be configured to dispense a chemical agent onto an interior surface 92 of enclosed environment 90, wherein the chemical agent may adhere to the interior surface 92 and to the floral infestations 91. Alternatively, a chemical agent may be dispensed into enclosed environment 90 for regular maintenance, including removing organic and inorganic deposits, physical or chemical blockages, and other impediments.

Apparatus 100 may be coupled with a pressurized liquid source 80. For example, the pressurized liquid source 80 may be a jetter truck, a jetter unit transported via trailer to a work site, or another suitable source of a pressurized liquid. In the example shown in FIG. 1, the pressurized liquid source 80 includes a liquid storage tank 81, a pump 82, a hose 83, and a reel assembly 84. The reel assembly 84 may include a motor configured for driving the hose 83 from the reel assembly 84, and for retrieving the hose 83 back into the reel assembly 84. Apparatus 100 may couple with the hose 83 at an inlet cap end 102 of the apparatus.

Apparatus 100 may be configured to utilize pressurized liquid from the pressurized liquid source 80 to propel in a generally longitudinal direction along the enclosed environment 90, as shown in FIG. 1. As will be discussed in detail below, apparatus 100 may utilize a plurality of jet nozzles through which the pressurized liquid may pass, thereby propelling the apparatus 100 and coupled hose 83 forward along the enclosed environment. Apparatus 100 may include an excess flow valve, which when exposed to a relatively high pressure liquid, enables the liquid to exit the plurality of nozzles. However, when the excess flow valve is exposed to a relatively low pressure liquid, the liquid may be channeled through a chemical storage tank to be used in foam generation. The foam may then be dispersed from a nozzle at an outlet cap end 104 of apparatus 100.

Figure 2:
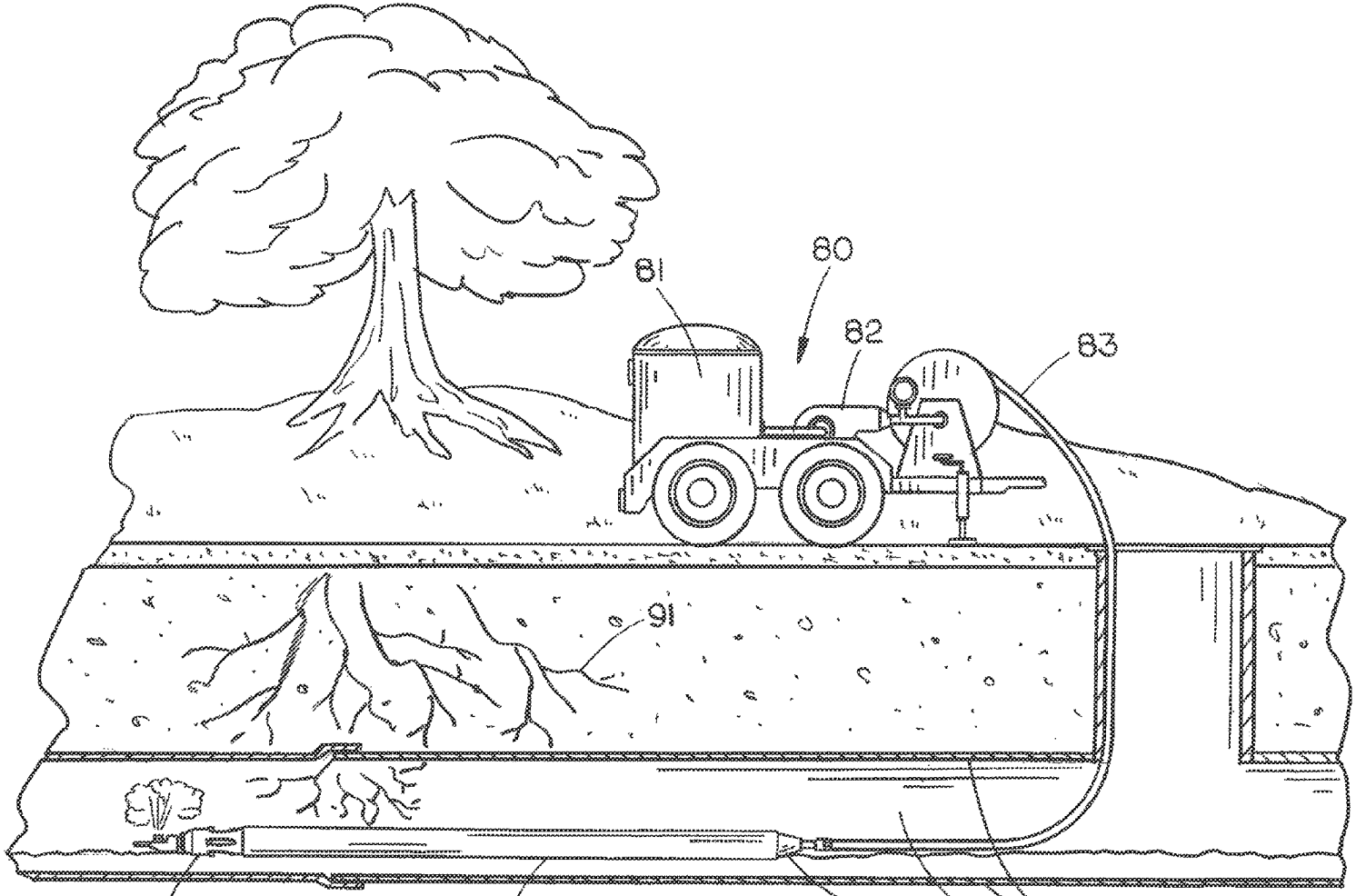
FIG. 2 is a sectional elevation view of the enclosed environment of FIG. 1, wherein the apparatus is dispensing a chemical agent via a foam, coating the inner surfaces of the enclosed environment.

Referring now to FIG. 2, a sectional elevation view of the enclosed environment 90 is shown, wherein the apparatus is dispensing a chemical agent via a foam, coating the inner surfaces 92 of the enclosed environment 90. For example, a relatively low pressure liquid may be pumped from the pressurized liquid source 80 causing a foam to be dispersed from a nozzle at an outlet cap end 104 of apparatus 100. The reel assembly 84 may retract the hose 83, which is coupled with apparatus 100. The apparatus 100 may be retracted through the enclosed environment 90 in a direction approximately opposite the generally longitudinal direction traveled while fluid-propelling via the plurality of jet nozzles. A chemical agent (e.g., in a foam form) may be dispersed from the nozzle onto the inner surfaces 92 of the enclosed environment 90.

Figure 3A:
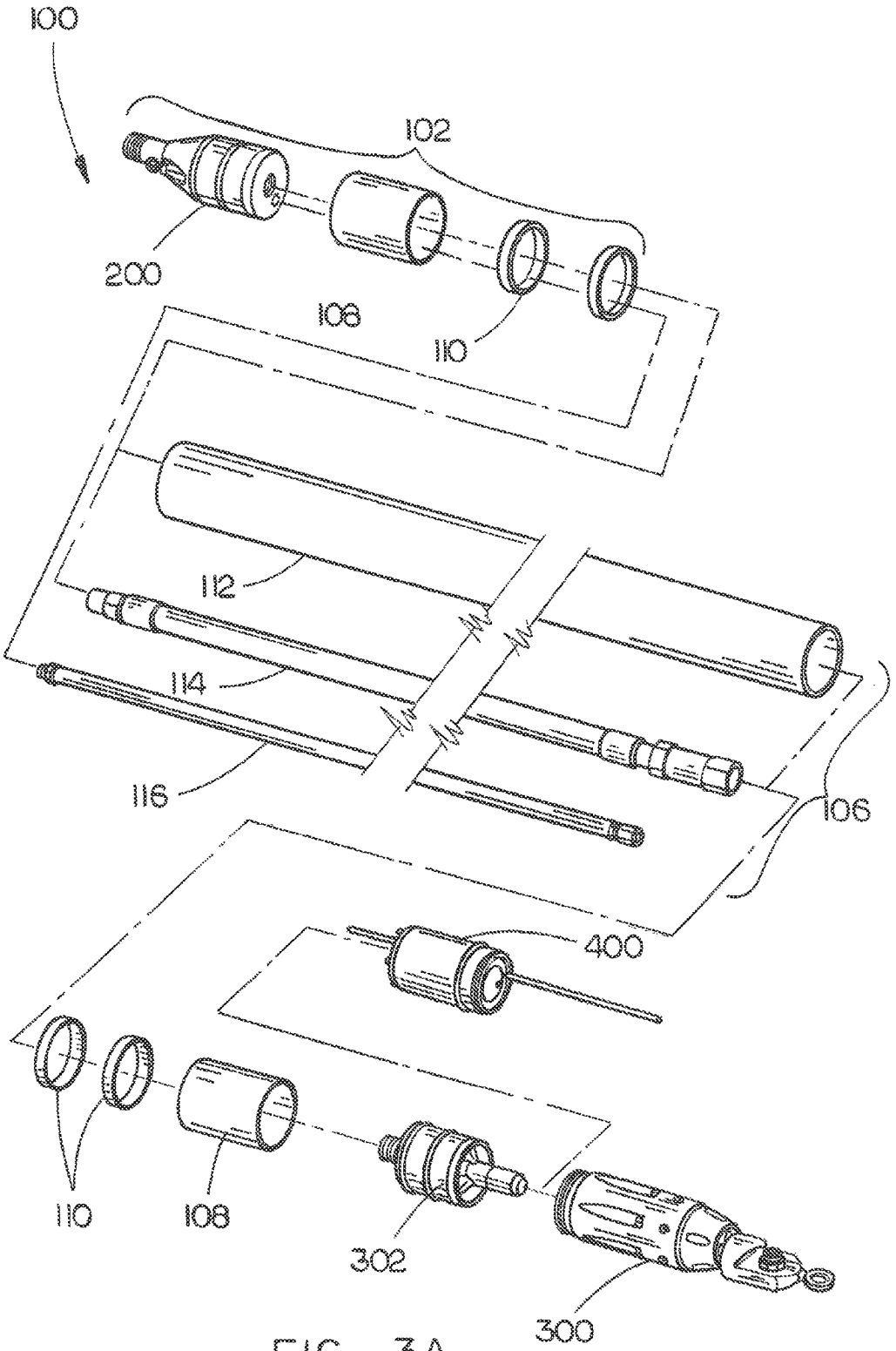
FIG. 3A is a partially exploded view of an apparatus according to an embodiment of the present disclosure.
Figure 3B:
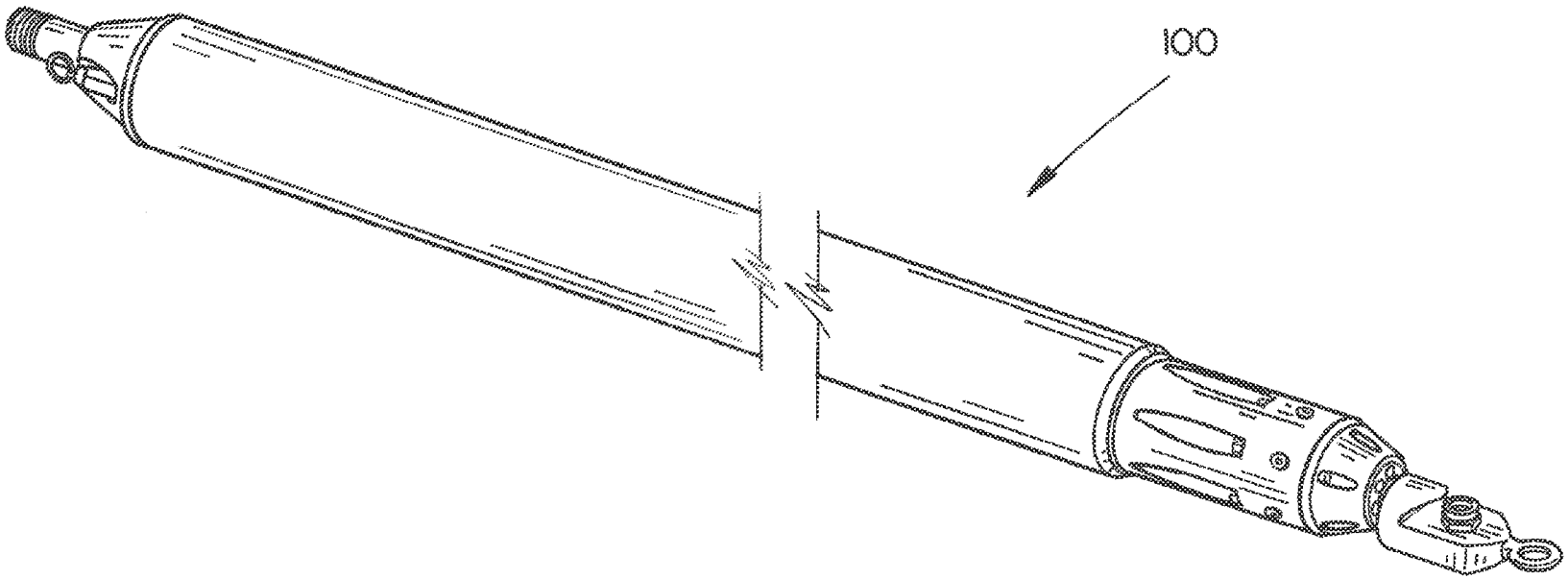
FIG. 3B is an isometric view of the apparatus of FIG. 3A.
Figure 4A:
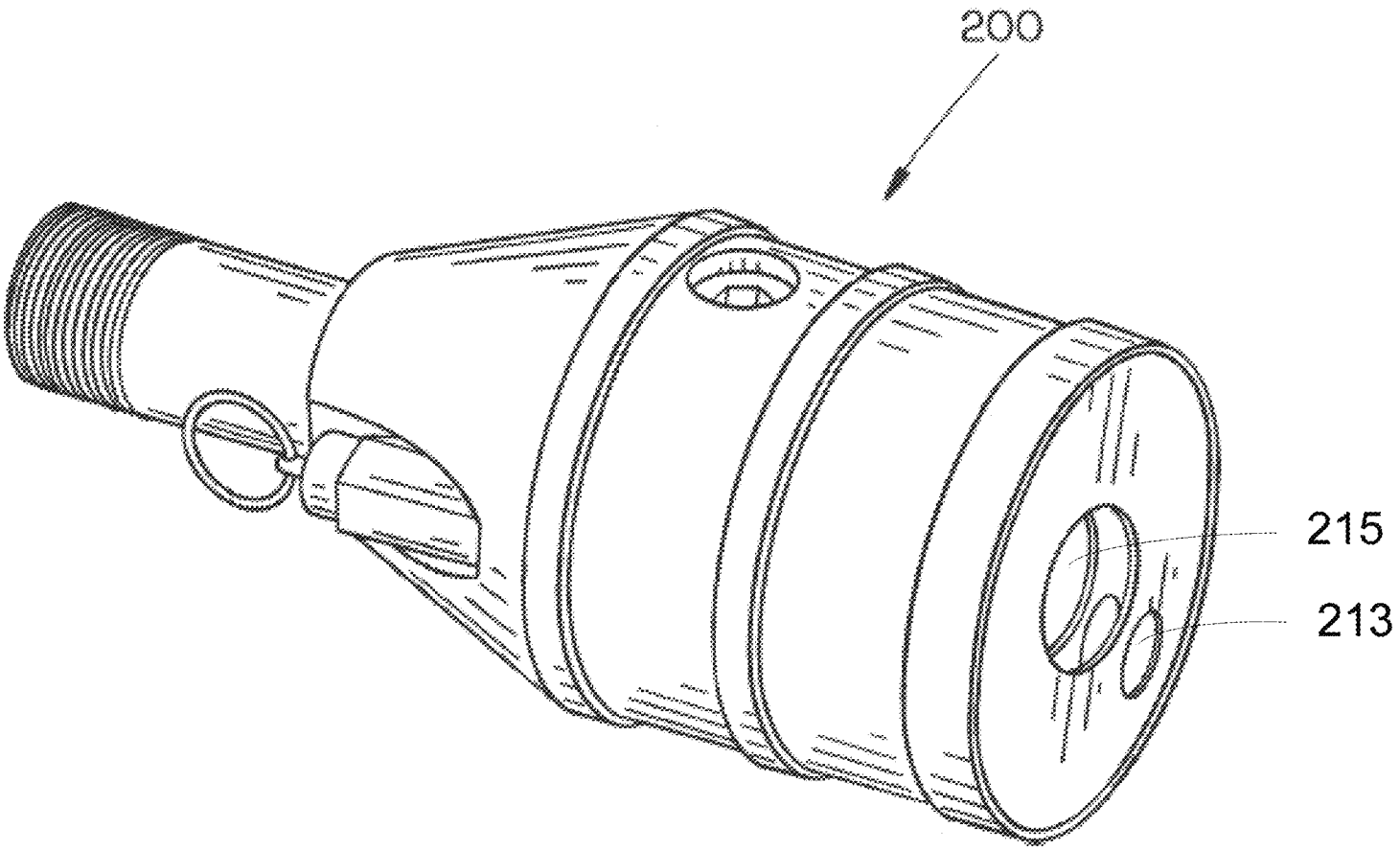
FIG. 4A is an isometric view of an inlet cap of the apparatus of FIG. 3A.
Figure 4B:
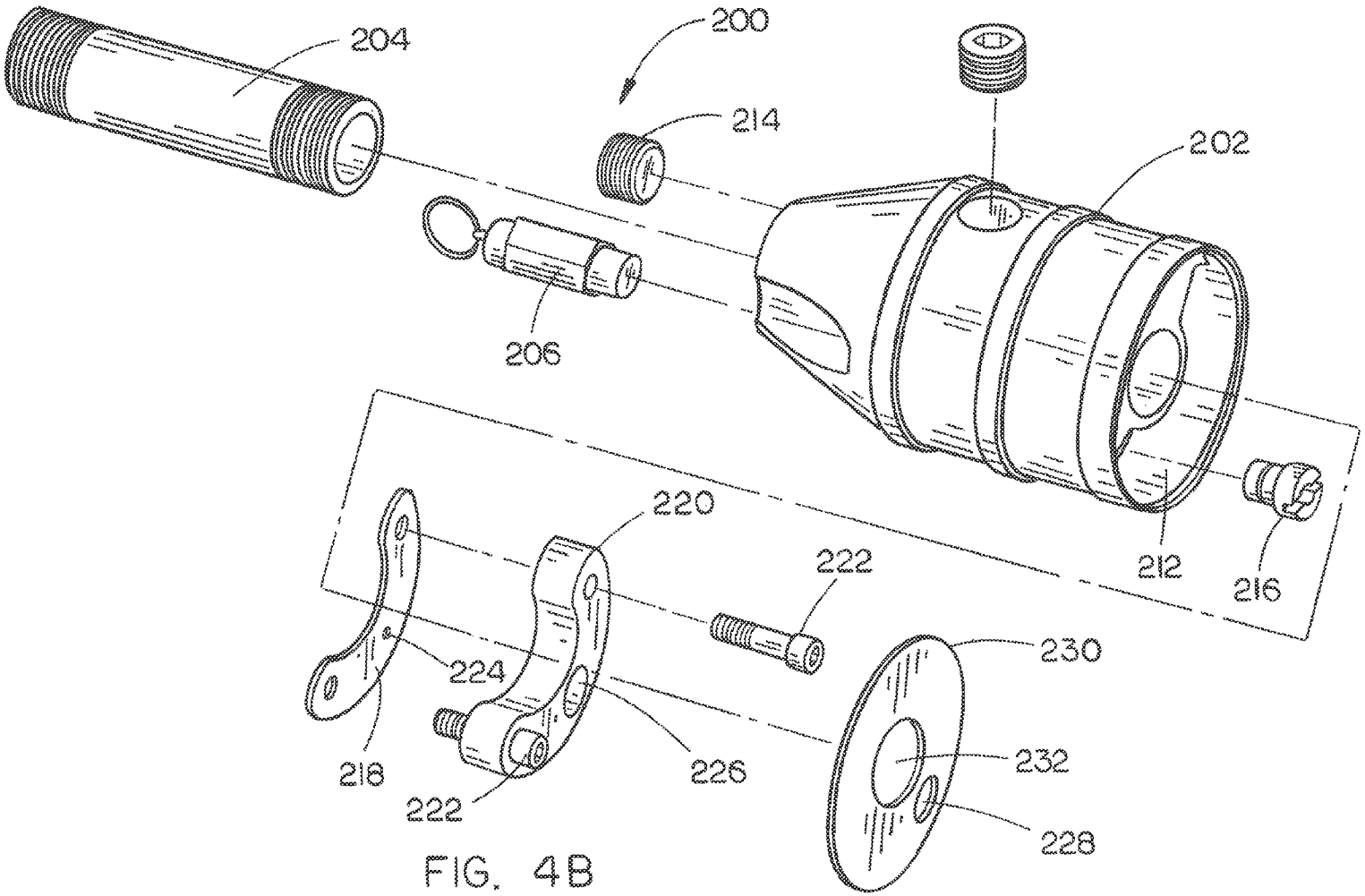
FIG. 4B is an exploded view of the inlet cap of FIG. 4A.
Figure 5A:
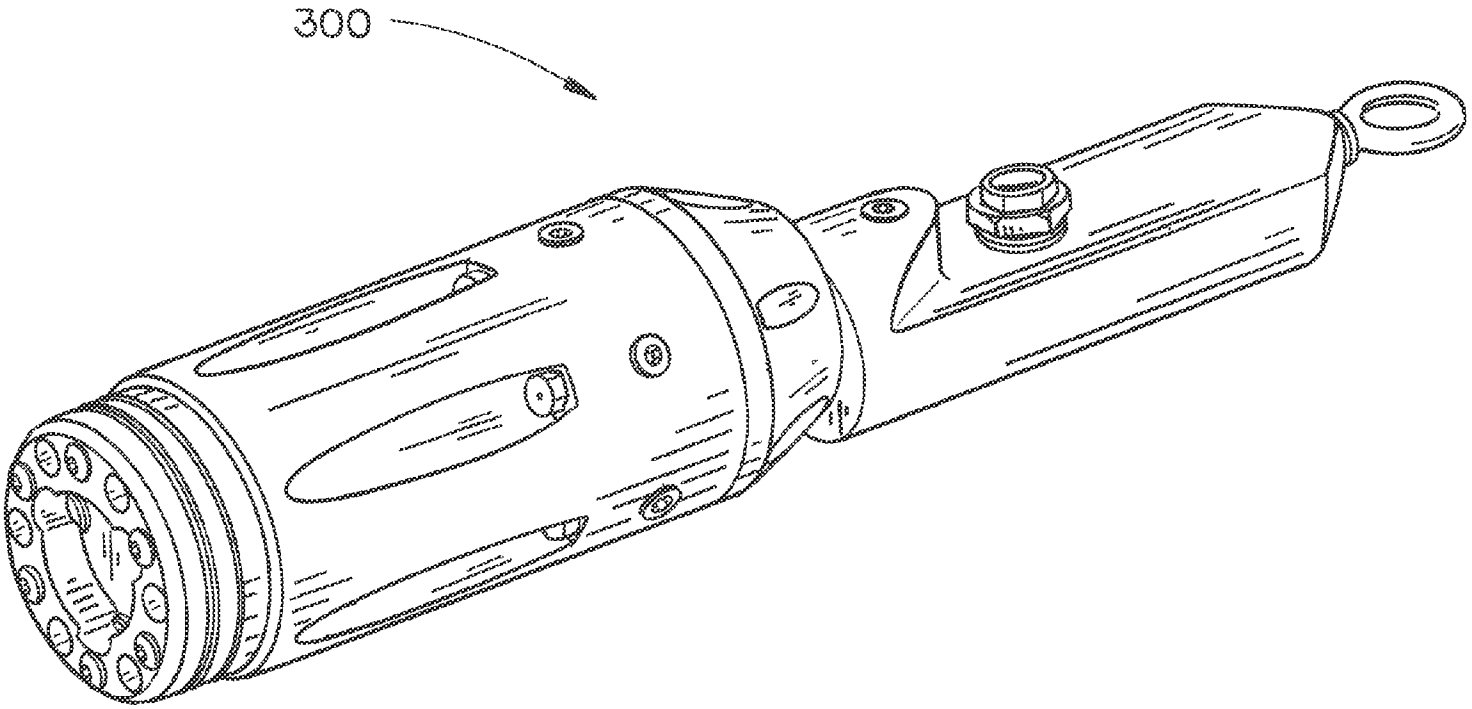
FIG. 5A is an isometric view of the outlet cap of the apparatus of FIG. 3A.
Figure 5B:
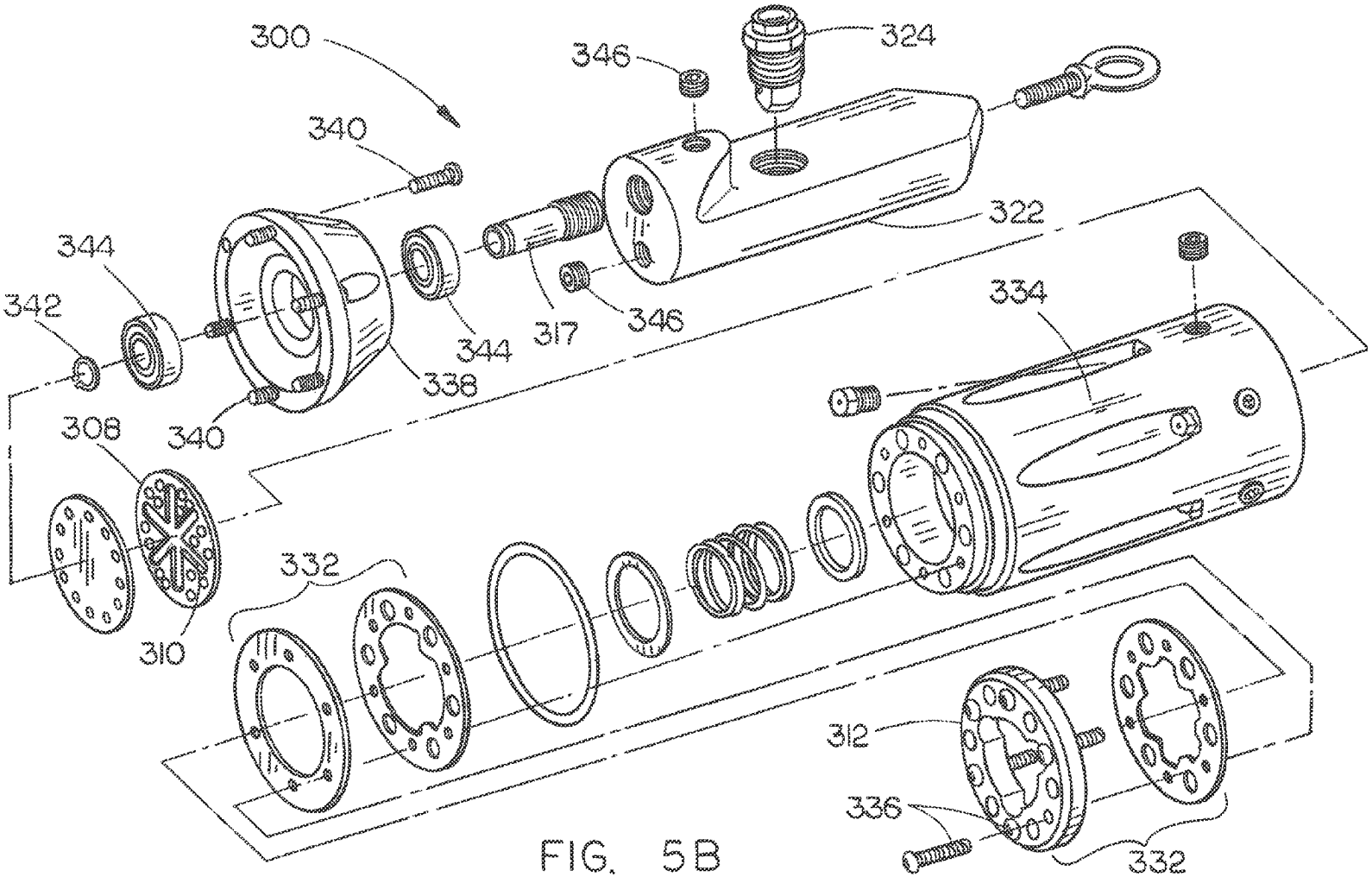
FIG. 5B is an exploded view of the outlet cap of FIG. 5A.

Referring now to FIGS. 3A and 3B, a partially exploded view and an isometric view of the apparatus 100 is displayed according to an embodiment of the present disclosure. Apparatus 100 may include three primary sections: an inlet cap end 102, an outlet cap end 104, and a chemical storage assembly 106. Generally, the inlet cap end 102 may include an inlet cap assembly 200, a protective sleeve 108, and a pair of band clamps 110. The outlet cap end 104 may generally include an outlet cap assembly 300, an outlet end connector 301, a protective sleeve 108, and a pair of band clamps 110. The outlet cap end 104 may also include a fill tube assembly 400. The fill tube assembly 400 and the outlet cap assembly 300 may be configured for interchangeable connection to the outlet cap end 104 for filling the apparatus 100 with a chemical agent (via the fill tube assembly 400) and for transporting the apparatus 100 to a work zone and delivering the chemical agent to an enclosed environment (via the outlet cap assembly 300). The chemical storage assembly 106 may generally include an external hose 112, a jetter hose 114, and a metering hose 116. The inlet cap assembly 200, outlet cap assembly 300, fill tube assembly 400, and chemical storage assembly 106 will be discussed in detail below.

Referring now to FIGS. 4A-6D, particular embodiments of the inlet cap assembly 200, the outlet cap assembly 300, and the chemical storage assembly 106 are shown. The inlet cap assembly 200 may include an inlet cap body structure 202 having a generally cylindrical structure. The inlet cap body structure 202 may include a tapered end for mating with a hose coupler 204 which may be configured to couple with a hose or line from a pressurized liquid source. In one embodiment, the hose coupler 204 is a pipe nipple with threaded connections. Liquid entering the inlet cap assembly via the hose coupler 204 may enter into one or more of channels 206, 208 (FIG. 6C). Channel 206 may lead to jetter hose 114, which may be connected to channel 206 via a hose fitting. The jetter hose 114 may run through the chemical storage assembly 106 toward an inline check valve 302 of the outlet cap end 104. At a relatively high pressure, the inline check valve 302 permits fluid from the jetter hose 114 to pass into an outlet channel 304 of outlet end connector 301 and into the outlet cap assembly 300. For instance, in one embodiment, the relatively high pressure may be approximately 400 psi and greater, more particularly approximately 1000 psi and greater, and even more particularly, may be approximately 2000 psi and greater. It may be appreciated that other pressures and/or pressure ranges be utilized according to the desired usage and design parameters of the apparatus 100. The liquid in the outlet channel 304 may subsequently be ejected from the outlet cap assembly 300 via a plurality of jetter nozzles 306. In a particular embodiment, the outlet channel 304 transfers fluid to an aperture defined by a plate 308 (FIG. 5B), which includes a symmetric pattern with six channels 310 into which the fluid may pass. Accordingly, fluid may exit each jetter nozzle 306 symmetrically, e.g., at an approximately equivalent rate, allowing the apparatus a controlled movement through the enclosed environment 90.

When fluid in the jetter hose 114 is at a pressure less than a specified pressure (e.g., less than the relatively high pressure), the inline check valve 304 may prevent the fluid from entering the outlet channel 304. Thus, when the pressurized liquid from the pressurized liquid source is maintained at a pressure less than the specified pressure, the liquid may not enter the outlet channel 304 and may not exit via the jetter nozzles 306, thereby the apparatus 100 may not be propelled forward by the force of liquid exiting the jetter nozzles 306. The apparatus 100 may dispense the chemical agent when the pressurized liquid from the pressurized liquid source is maintained at a pressure less than the specified pressure, as will be discussed further below.

The tapered end of the inlet cap body structure 202 may also include a safety valve 206 adjacent the hose coupler 204. The safety valve 206 may be configured to relieve pressure of the inlet cap assembly and the chemical storage chamber 106. For example, the safety valve 206 may be manually activated by an operator for relieving excess pressure within inner chambers of the apparatus, such as prior to opening a portion of the apparatus for cleaning, maintenance, storage, and the like.

At the relatively high pressure, the pressurized liquid which enters channel 208 of the inlet cap assembly 200 may be prevented from entering the jetter hose 114 by an integrated excess flow valve 210. For instance, the excess flow valve 210 may be configured to block fluid from flowing to a bypass chamber 212 and out a flow valve outlet 213 (FIG. 4A) when the fluid is at a pressure greater than a specified pressure, and may allow fluid at a pressure less than the specified pressure to flow into the bypass chamber 212. When the fluid is above the specified pressure, the fluid may travel through channel 206 and through a flow valve outlet 215 (FIG. 4A) to the jetter hose 114, as described above. The bypass chamber 212 may lead through the inlet cap body structure 202 to a bypass orifice plug 214, through which water may exit the inlet cap assembly 200. The bypass orifice plug 214 may be included in the tapered end of the inlet cap body structure 202, adjacent the hose coupler 204. In a particular embodiment, the bypass orifice plug 214 may be replaceable, such as by an operator, such that a specific orifice size/diameter is selected. For example, with a given volume of fluid entering the inlet cap assembly 200, pressure within the bypass chamber 212 may be regulated by the bypass orifice plug 214, such that a controlled amount of fluid enters the bypass chamber 212. An operator may determine the rate/volume of fluid from the pressurized fluid source according to means known in the art, such as by using a flowmeter, or filling a known volume with water and recording the time required.

Fluid exiting the excess flow valve 210 may exit via a valve cap 216 into the bypass chamber 212. The bypass chamber 212 may be at least partially sealed from the chemical storage assembly 106 by a bypass seal 218 secured by a bypass cover plate 220 with fasteners 222 configured to mate with the inlet cap body structure 202. The bypass seal 218 may define a wetting aperture 224 through which at least a portion of the fluid in the bypass chamber 212 may pass. Fluid passing through the wetting aperture 224 may subsequently pass through a cover plate aperture 226 and through a screen aperture 228 into metering hose 116. The screen aperture may be defined by screen 230, which may be configured for placement between the inlet cap assembly 200 and the chemical storage assembly 106. The screen 230 may further define a jetter aperture 232 through which one or more of the channel 206 or the jetter hose 114 may pass.

The metering hose 116 may be contained within external hose 112 of the chemical storage assembly 106. The metering hose may comprise a fluid-permeable material, which may be designed to allow approximately 1 to 3 gallons of fluid per minute to permeate the metering hose 116 at a pressure of approximately 60 to 140 psi. The metering hose 116 may include a capped end 108 configured to retain fluid inside the metering hose 116 until permeation of the fluid through the hose material. In a particular embodiment, the metering hose 116 may be configured to allow approximately 1.7 to 2.0 gallons of fluid per minute to permeate the metering hose 116 at a pressure of approximately 80 to 120 psi.

Figures 6A, 6C:
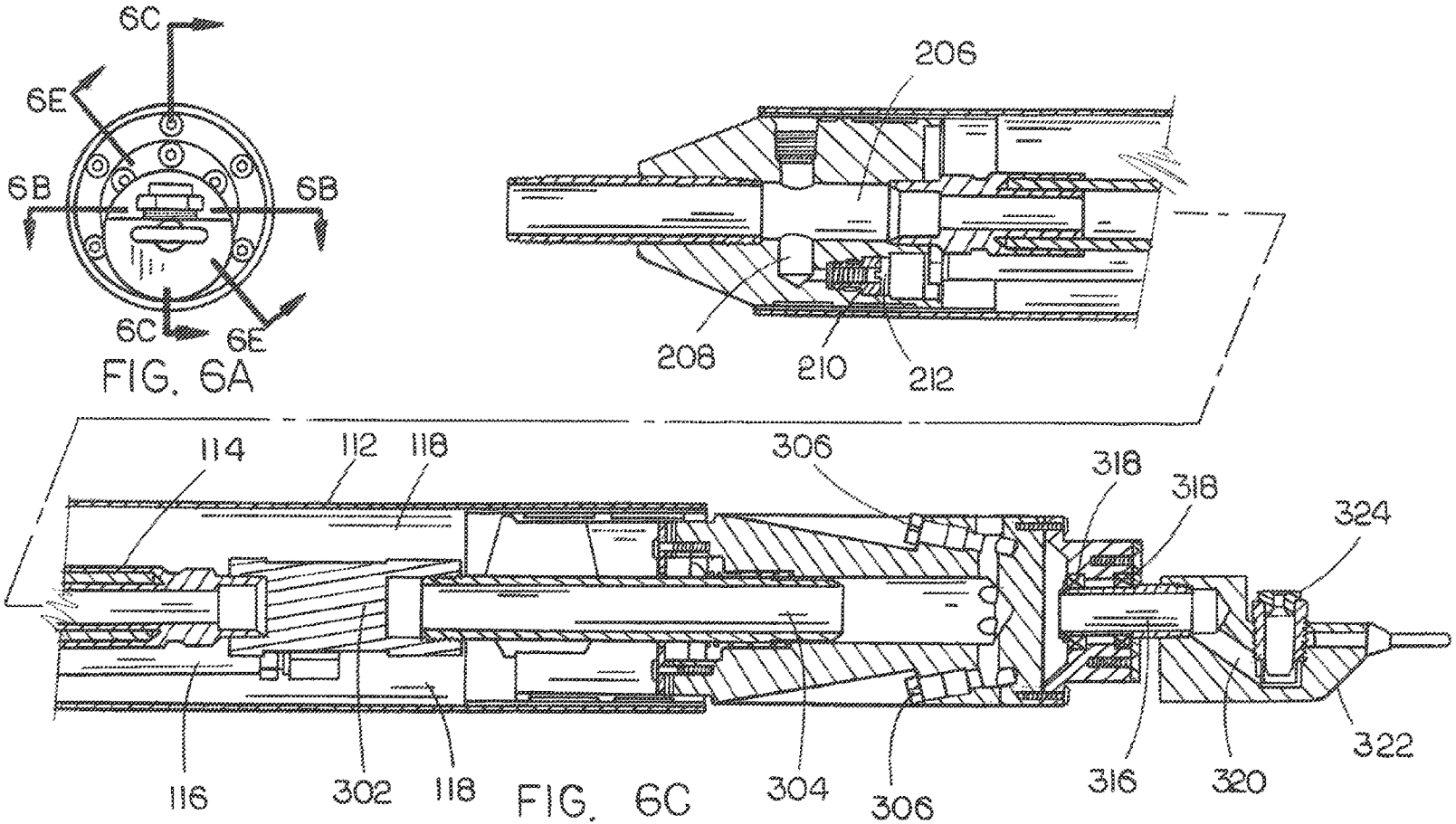
FIG. 6A is an end view of the apparatus of FIG. 3A, viewed from an outlet cap end.
FIG. 6C is a partial side elevation cross sectional view of the apparatus of FIG. 3A.
Figures 6B, 6D:
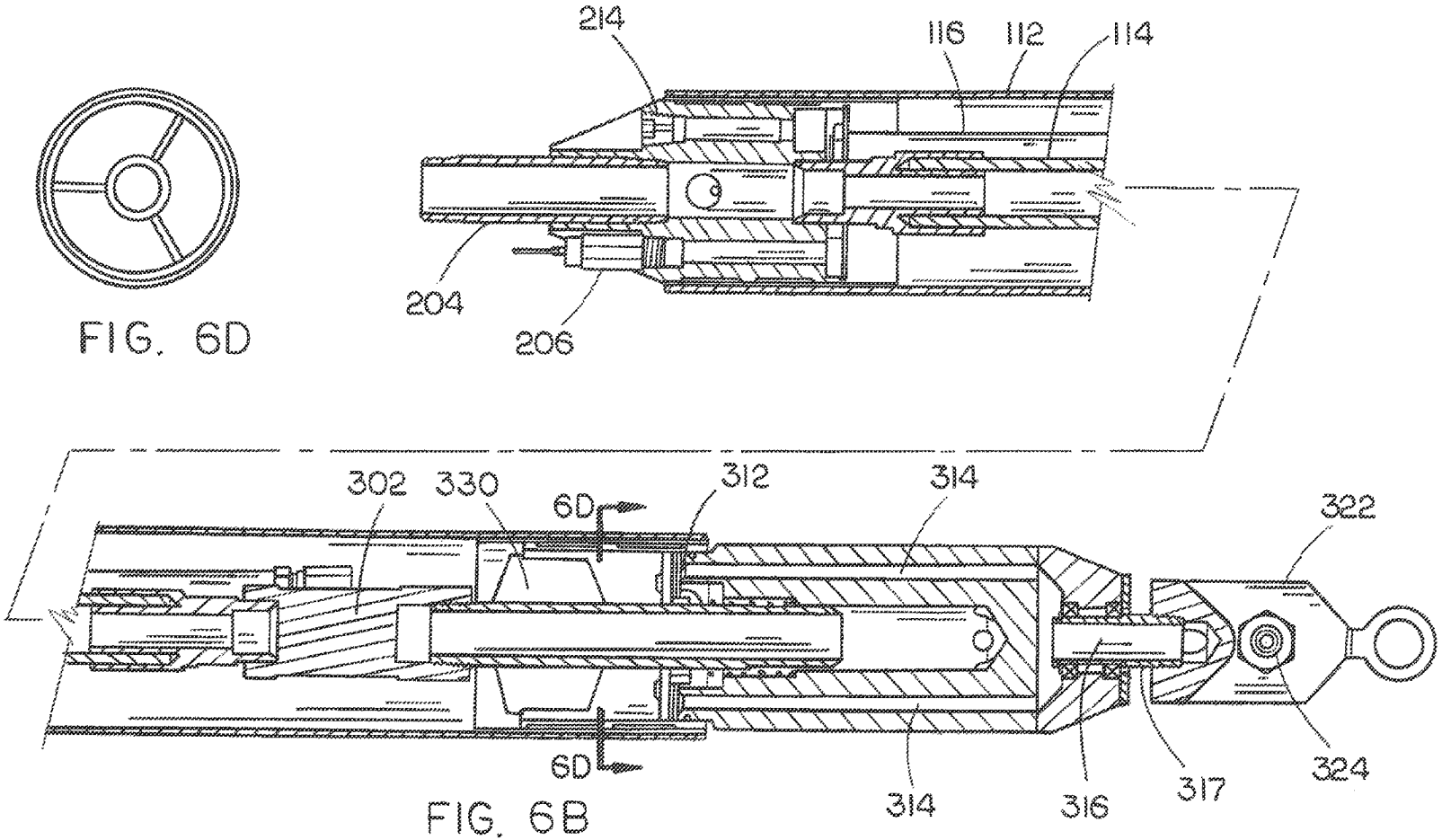
FIG. 6B is a partial top elevation cross sectional view of the apparatus of FIG. 3A.
FIG. 6D is a cross sectional view of a chemical storage chamber of the apparatus of FIG. 3A.
Figure 6E:
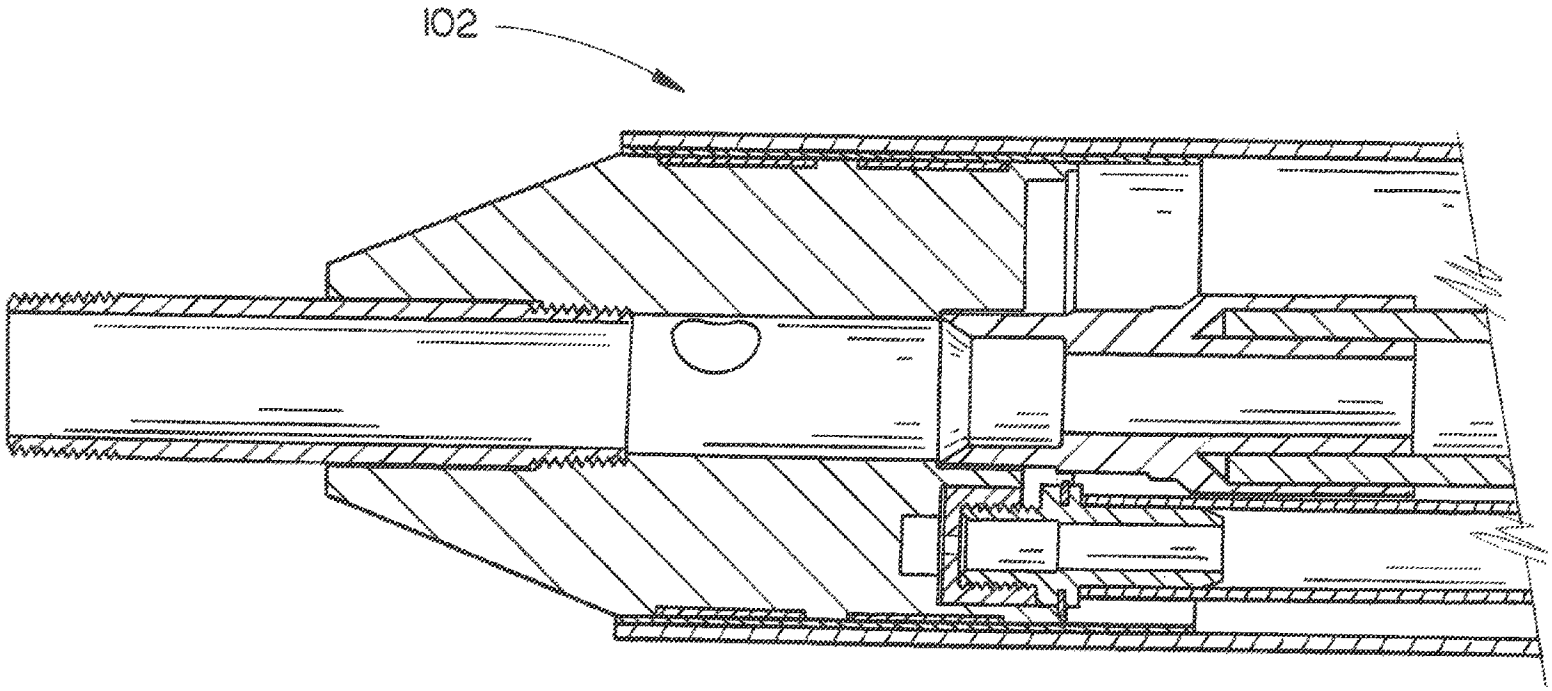
FIG. 6E is a partial side elevation cross section view of the apparatus of FIG. 3A, viewed at 40 degrees from a vertical plane longitudinally bisecting the apparatus.

The chemical storage assembly 106 may be loaded with a chemical agent (described in detail below), which may mix with fluid permeated from the metering hose 116 into the external hose 120. For instance, the chemical agent may be contained within fill areas 118 (FIG. 6D) of the chemical storage assembly 106. In a particular embodiment, the fluid from the pressurized fluid source mixes with the chemical agent to form a foam which may be forced by the pressure through the outlet end connector 301 toward a screen plate 312 of the outlet cap assembly 300 and subsequently toward a plurality of foam delivery channels 314 (FIG. 6B). In a particular embodiment, the outlet cap assembly 300 includes six foam delivery channels 314, arranged in an approximately symmetric pattern for consistent flow. The foam delivery channels 314 may converge to a rotatable channel 316, which may be rotatable relative to the stationary foam delivery channels 314 via a plurality of bearings 318. The rotatable channel 316 may be defined by a nozzle pivot axle 317, which may be configured to rotatably connect an outlet cap head 338 to a nozzle head 322. The rotatable channel 316 may lead to a nozzle channel 320 located within nozzle head 322. The nozzle head 322 may include a nozzle 324 through which the chemical agent/water mixture may exit the apparatus 100. In a particular embodiment, the nozzle head 322 is eccentrically weighted, such that the nozzle 324 is configured to point upward relative to a base of the enclosed environment 90. The nozzle head 322 may include one or more plugs 346 configured to seal machine-access channels (e.g., for forming channel 320 in the nozzle head 322).

Further, the nozzle 324 may be configured to direct the chemical agent/water mixture to the upper half of the enclosed environment 90. For example, if the enclosed environment 90 is a sewer pipe, the nozzle may spray the mixture to substantially the top half of the inner circumference of the sewer pipe, thereby coating the areas into which encroaching flora may grow. In such an instance, the nozzle 324 may be a conical-shaped nozzle, a whirl-jet nozzle, or the like. However, other spray configurations and nozzle types may be appreciated by those of skill in the art without detracting from the scope of the present disclosure.

Figures 7A, 7B:
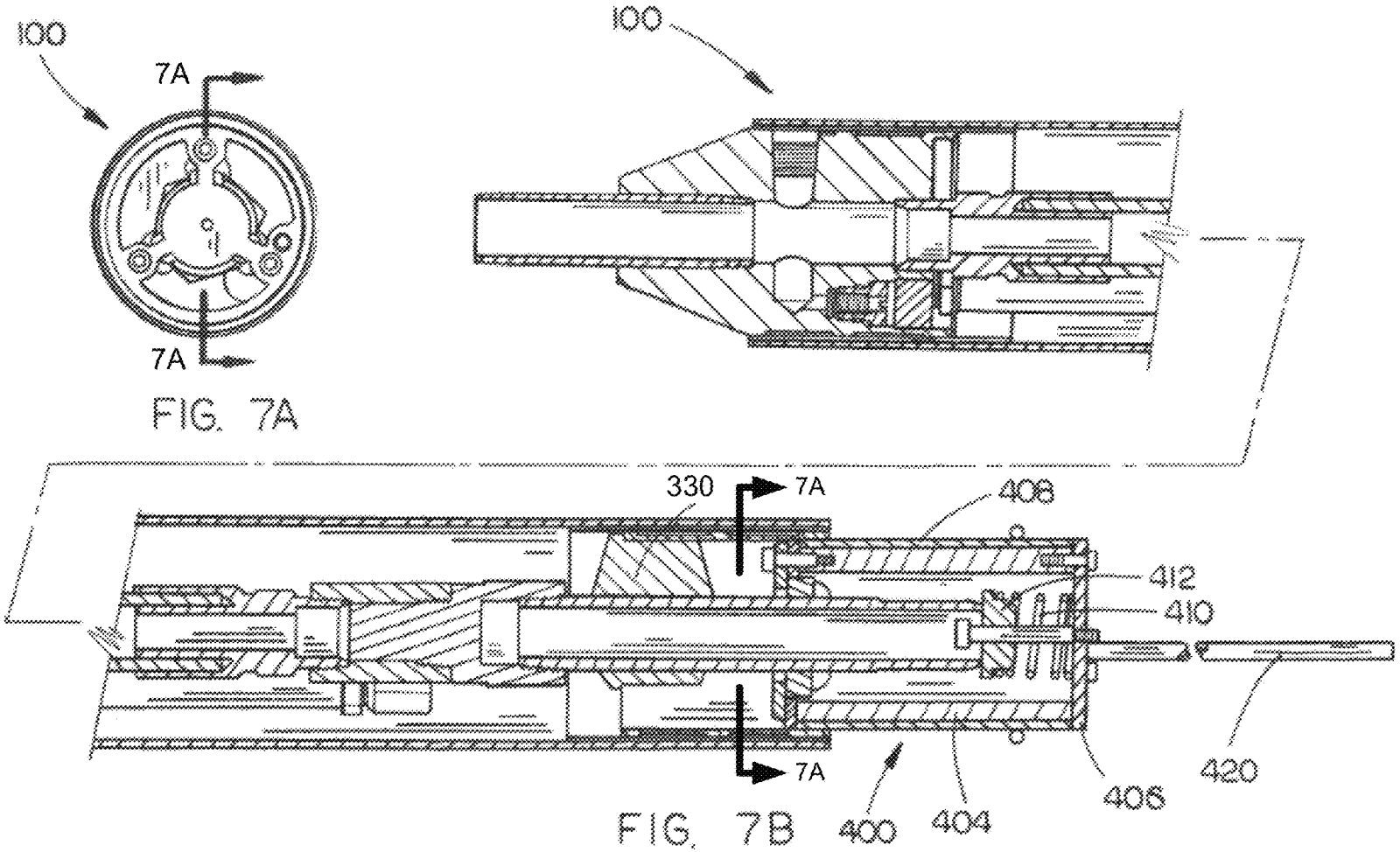
FIG. 7A is an end view of an apparatus according to another embodiment, view from an outlet end of the apparatus.
FIG. 7B is a partial side elevation cross section view of the apparatus of FIG. 7A.
Figure 7C:
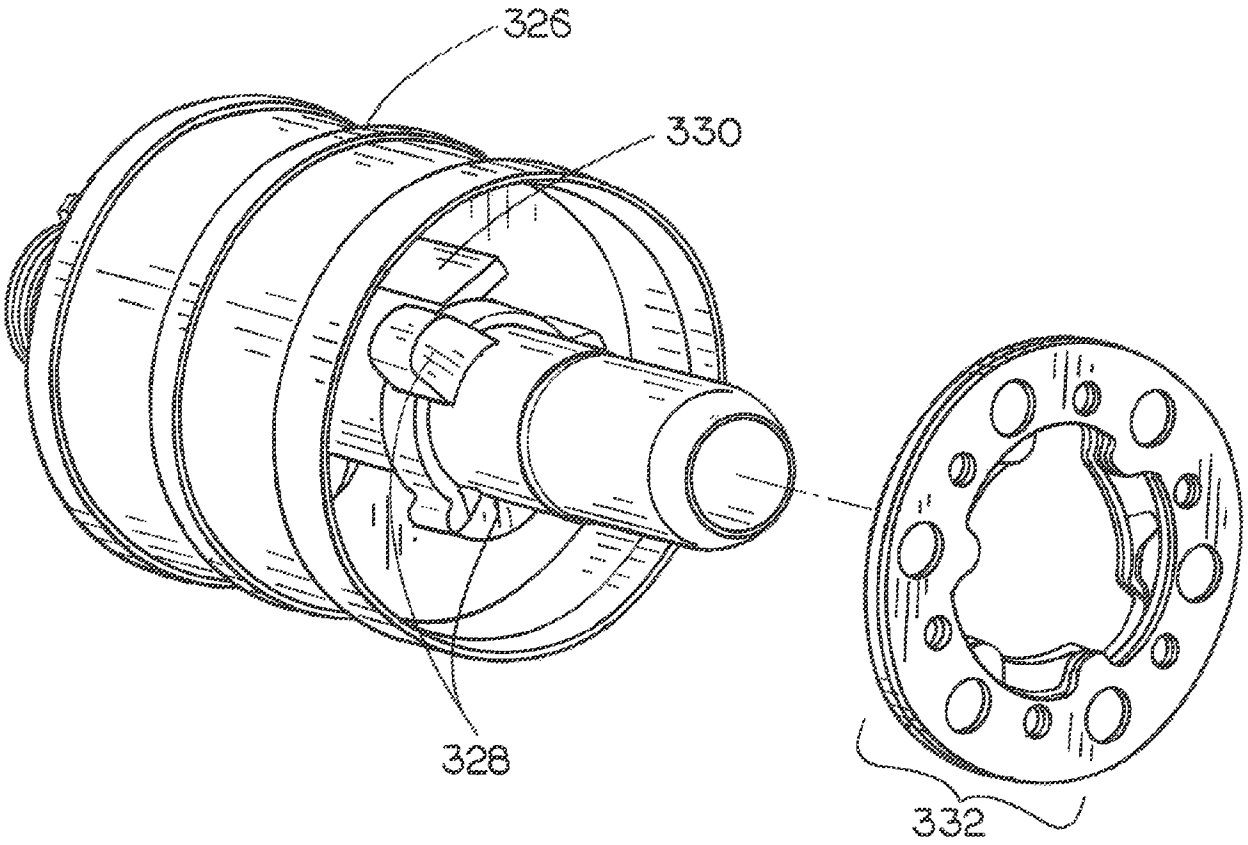
FIG. 7C is a partially exploded view of an outlet end portion of the apparatus of FIG. 7A.

The outlet cap assembly 300 may couple to the chemical storage assembly 106 via the outlet end connector 301. The outlet end connector 301 may include a connector structure 326 (FIG. 7C). In a particular embodiment, the connector structure 326 includes a plurality of bayonet lobes 328 and welds 330 configured to mate and lock with bayonet plates 332 of the outlet cap assembly 300, as shown in FIG. 7C. The bayonet plates 332 may be coupled to a body structure 334 of the outlet cap assembly 300 via a plurality of fasteners 336. The outlet cap assembly may include the outlet cap head 338, which may be coupled to the body structure 334 via a plurality of fasteners 340. In a particular embodiment, plates 308 and 310, shim 342, and seal 344 are retained between the outlet cap head 338 and the body structure 334.

Figure 8A:
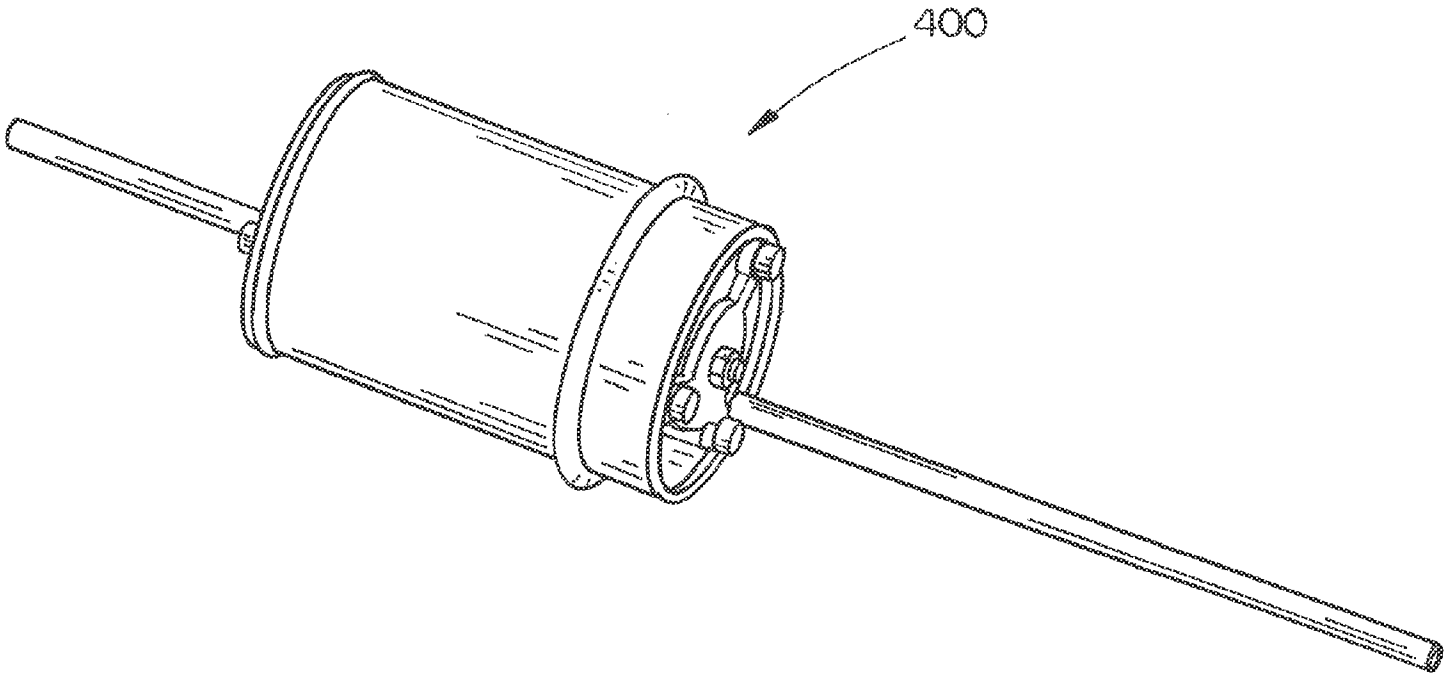
FIG. 8A is an isometric view of a filling attachment for the apparatus of FIG. 3A.
Figure 8B:
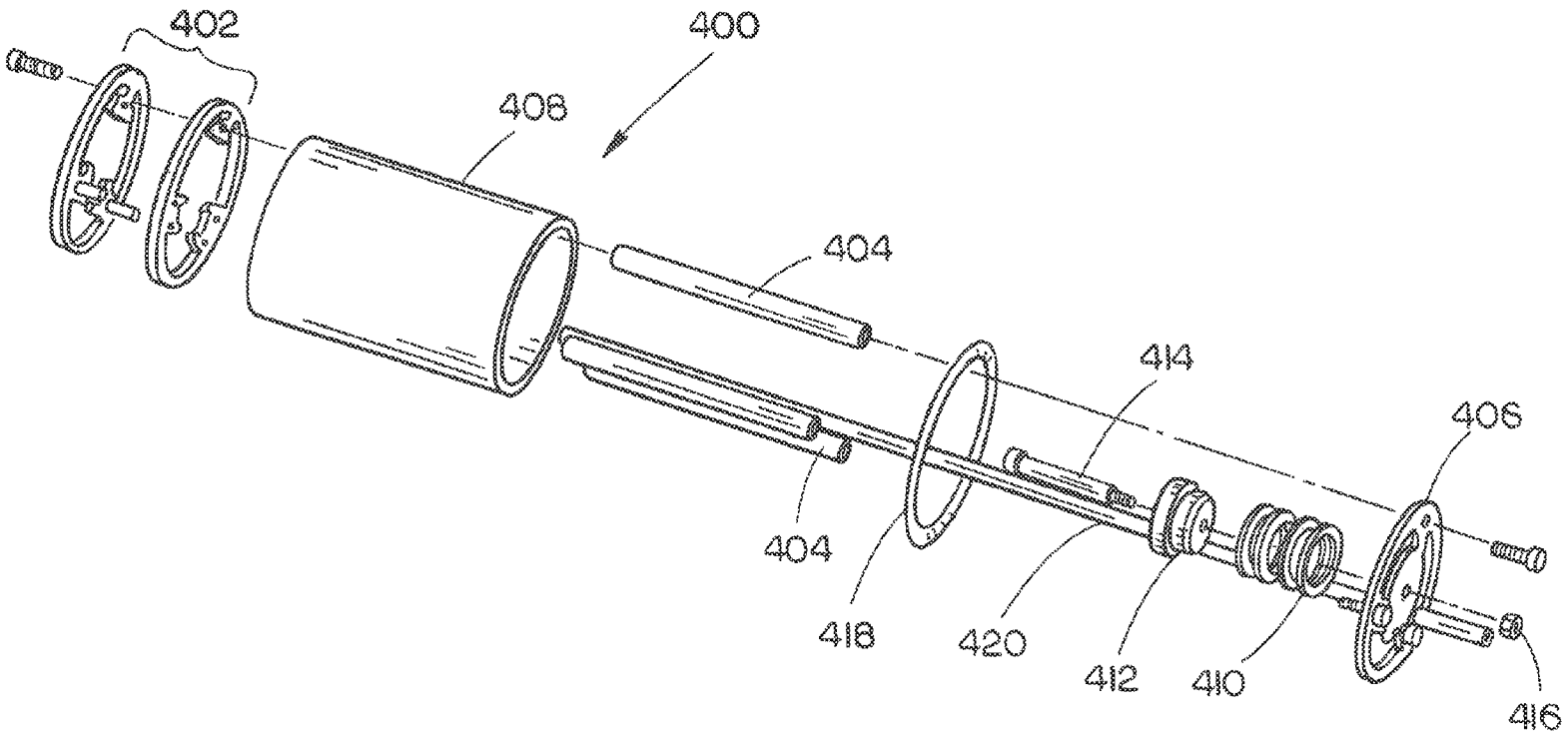
FIG. 8B is an exploded view of the filling attachment of FIG. 8A.

The outlet end connector 301 may be configured for separate coupling between the outlet cap assembly 300 and a fill tube assembly 400 of apparatus 100, described with reference to FIGS. 7B, 8A, and 8B. For instance, each of the outlet cap assembly 300 and the fill tube assembly 400 may be interchangeably coupled with the outlet end connector 301. The fill tube assembly 400 may be utilized to load the chemical agent into the apparatus 100. The bayonet connection between the outlet cap assembly 300 and the outlet end connector 301 may be uncoupled so that the fill tube assembly 400 may connect with the outlet end connector 301. For instance, the fill tube assembly 400 may include bayonet plates 402 configured to mate and lock with the plurality of bayonet lobes 328 and welds 330 of the connector structure 326. The fill tube assembly 400 may further include a plurality of fill port standoffs 404 which are configured to couple the bayonet plates 402 with a bayonet end plate 406. The fill port standoffs 404 may be enclosed within a fill tube structure 408, which may be capped by the bayonet plates 402 and the bayonet end plate 406. The bayonet end plate 406 may also be coupled with a compression spring 410 fastened to a spring holder 412 by a fastener 414 (e.g., a shoulder screw with a nut 416).

The fill tube assembly 400 may also include an O-ring 418 for retaining an outlet of a cartridge containing the chemical agent, such as during a fill operation by an operator. For instance, the cartridge may be similar to or that of the cartridge described in U.S. Pat. No. 5,735,955, entitled "Apparatus for Generating and Dispersing Foam Herbicide within a Sewer," of which the disclosure is incorporated by reference in its entirety. The fill tube assembly 400 may further include a breather tube 420, which may extend through each of the bayonet end plate 406, the fill tube structure 408 and the bayonet plates 402. The breather tube may assist in or permit the flow of the chemical agent from the cartridge to the chemical storage assembly 106, even when the fill tube assembly 400 forms an air-tight connection with the outlet end connector 301.

Alternatively, chemicals may be added to the water storage tank 81 of the pressurized liquid source 80, where the chemical/water mixture is pumped to the apparatus for dispensation.

Figure 9:
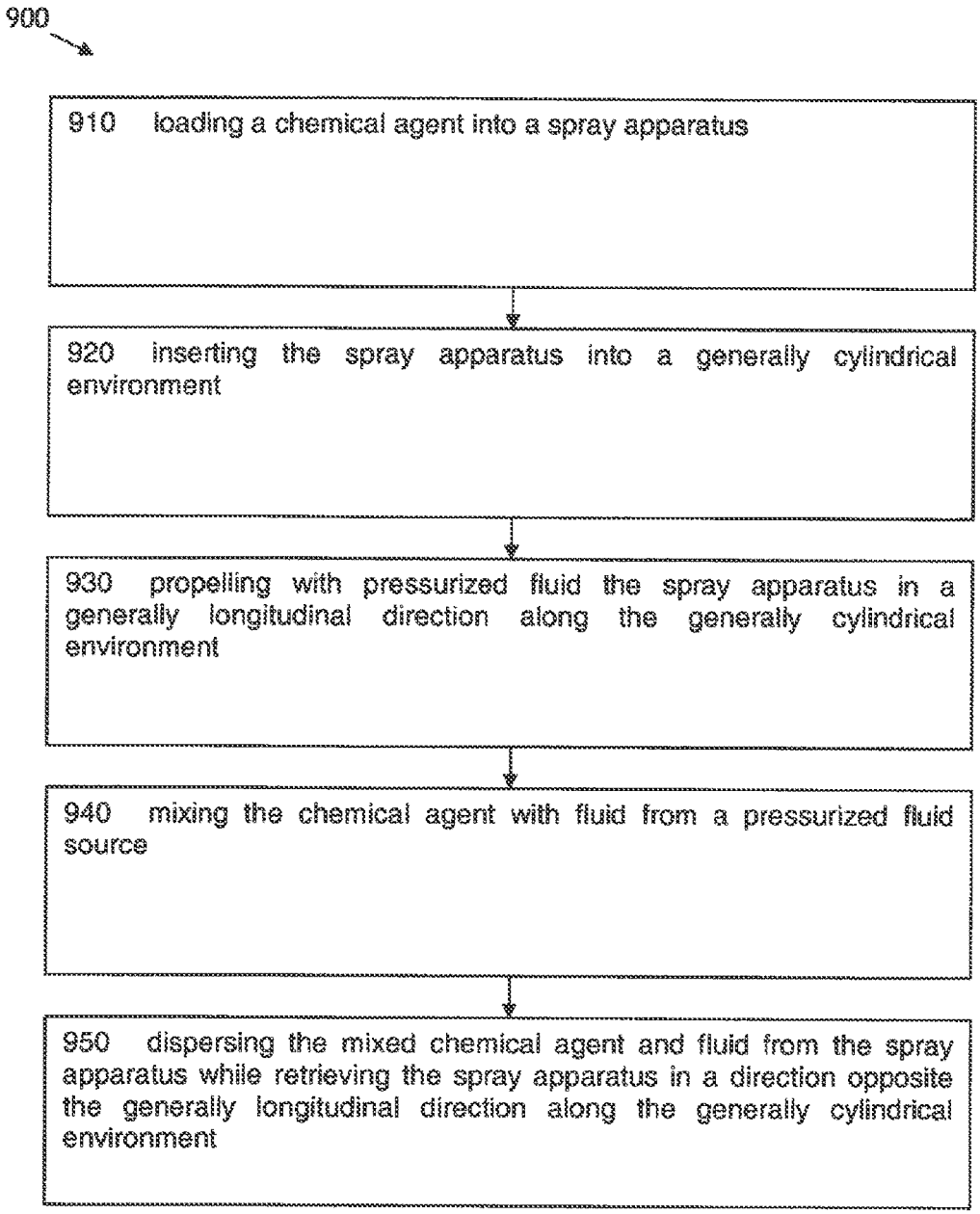
FIG. 9 is a flow diagram of a method for dispersing a chemical agent.

Referring now to FIG. 9, a flow chart of a method 900 for dispersing a chemical agent is shown. Method 900 may include loading a chemical agent into a spray apparatus 910. For instance, loading a chemical agent into a spray apparatus 910 may include connecting the cartridge containing the chemical agent to the fill tube assembly 400 and transfer the chemical agent into apparatus 100. Method 900 may also include inserting the spray apparatus into a generally cylindrical environment 920. For example, inserting the spray apparatus into a generally cylindrical environment 920 may include uncoupling the fill tube assembly 400 from the outlet end connector 301 and coupling the outlet cap assembly 300 to the outlet end connector 301 via the bayonet connection; coupling the hose 83 of the pressurized liquid source 80 to hose coupler 204 and lowering the outlet cap end 104 of apparatus 100 into the enclosed environment 90; and positioning the nozzle 324 outlet cap assembly 300 toward the desired direction of travel of the apparatus 100.

Method 900 may also include propelling with pressurized fluid the spray apparatus in a generally longitudinal direction along the generally cylindrical environment 930. For example, propelling with pressurized fluid the spray apparatus in a generally longitudinal direction along the generally cylindrical environment 930 may include reducing pressure from the pressurized liquid source 80 to an idle setting, such as when the apparatus 100 reaches a desired application location within the enclosed environment 90. Determining the location of the apparatus 100 may be accomplished via a camera mounted to apparatus 100, a positional-indicator, such as a GPS receiver, RF signal system, etc., or any other location-determining means known in the art. Step 930 may also include sending a pressurized fluid at a first pressure to the spray apparatus sufficient to propel the spray apparatus in the generally longitudinal direction along the generally cylindrical environment.

Method 900 may include mixing the chemical agent with fluid from a pressurized fluid source 940. For example, mixing the chemical agent with fluid from a pressurized fluid source 940 may occur in fill areas 118 of the chemical storage assembly 106 via fluid permeating out of metering hose 116, as described above. Step 940 may also include sending the pressurized fluid at a second pressure to the spray apparatus sufficient to mix the chemical agent with fluid from a pressurized fluid source. In a particular embodiment, the first pressure (from step 930) is greater than the second pressure (from step 940).

Method 900 may further include dispersing the mixed chemical agent and fluid from the spray apparatus while retrieving the spray apparatus in a direction opposite the generally longitudinal direction along the generally cylindrical environment 950. For example, step 950 may include retrieving the apparatus 100 via the reel assembly 84 when the chemical agent begins to disperse from the nozzle 324; and stopping pressure from the pressurized liquid source 80 when the desired amount of chemical agent has been dispensed onto the inner surfaces of the enclosed environment 90.

Preparatory steps for step 910 of method 900 may include: determining a rate of flow for the pressurized liquid source 80 at an idle pressure setting; selecting an orifice size for the bypass orifice plug 214, which may correspond with a desired internal pressure within the apparatus 100; inserting the bypass orifice plug 214 into the corresponding orifice defined by the inlet cap body structure 202; and, if applicable, uncoupling the outlet cap assembly 300 from the outlet end connector 301 and couple the fill tube assembly 400 to the outlet end connector 301 via the bayonet connection.

It is believed that the present disclosure and many of its attendant advantages will be understood by the foregoing description, and it will be apparent that various changes may be made in the form, construction and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. An apparatus comprising:

an intake assembly, the intake assembly including a connector and an excess flow valve, the connector configured for coupling to a pressurized liquid source, the pressurized liquid source supplying a pressurized liquid to the intake assembly, the excess flow valve in fluid communication with a first flow valve outlet and a second flow valve outlet to direct the pressurized liquid from the intake assembly to one or more assemblies upon application of a first pressure or a second pressure;

an outlet assembly, the outlet assembly being coupled to the first flow valve outlet of the intake assembly to receive pressurized liquid from the first flow valve outlet upon application of the first pressure, the outlet assembly including a first outlet configured for expelling pressurized liquid from the pressurized liquid source in a first direction at a rate sufficient to induce approximately lateral movement of the apparatus, the outlet assembly including a second outlet configured for expelling at least one of a chemical or a chemical mixed with a liquid in a second direction; and a chemical storage assembly, the chemical storage assembly being coupled to the second flow valve outlet of the intake assembly to receive pressurized liquid from the second flow valve outlet upon application of the second pressure, the first pressure being higher than the second pressure, the chemical storage assembly being configured for at least one of (a) storing the chemical or (b) mixing the chemical with the liquid from the pressurized liquid source.

2. The apparatus of claim 1, further including:

a permeable metering hose disposed within the chemical storage assembly, the permeable metering hose coupled with the second flow valve outlet; and a fluid line coupled between the intake assembly and the outlet assembly, the fluid line configured to transfer fluid from the first flow valve outlet to the outlet assembly.

3. The apparatus of claim 2, further including:

a check valve coupled between the fluid line and the outlet assembly, the check valve configured to direct fluid at the first pressure to the outlet assembly and configured to prevent fluid at the second pressure from entering the outlet assembly.

4. The apparatus of claim 1, wherein the first outlet of the outlet assembly includes a plurality of nozzles configured for expelling pressurized liquid from the pressurized liquid source.

5. The apparatus of claim 4, wherein each one of the plurality of nozzles defines an orifice having a diameter sized at least approximately the same as the other ones of the plurality of nozzles.

6. The apparatus of claim 1, wherein the second outlet of the outlet assembly is a chemical agent nozzle, the chemical agent nozzle coupled to an eccentrically-weighted nozzle head.

7. The apparatus of claim 1, further including a fill tube assembly including at least one inlet port configured for receiving the chemical agent, the fill tube assembly configured for receiving the chemical agent into the apparatus.

8. The apparatus of claim 7, wherein the fill tube assembly and the outlet assembly are each configured for removable coupling to an outlet end connector via a bayonet locking system, the outlet end connector configured for coupling between the chemical storage assembly and at least one of the fill tube assembly and the outlet assembly.

9. The apparatus of claim 8, wherein the bayonet locking system comprises the outlet end connector including a bayonet connection end and each of the fill tube assembly and the outlet assembly including a bayonet plate configured to mate with the bayonet connection end of the outlet end connector.

10. A system, comprising:

a pressurized liquid source; and a spray apparatus configured for placement in an enclosed environment, the spray apparatus including:

an intake assembly, the intake assembly including a connector and an excess flow valve, the connector configured for coupling to the pressurized liquid source, the pressurized liquid source supplying a pressurized liquid to the intake assembly, the excess flow valve in fluid communication with a first flow valve outlet and a second flow valve outlet to direct the pressurized liquid from the intake assembly to one or more assemblies upon application of a first pressure or a second pressure;

an outlet assembly, the outlet assembly being coupled to the first flow valve outlet of the intake assembly to receive pressurized liquid from the first flow valve outlet upon application of the first pressure, the outlet assembly including a first outlet configured for expelling pressurized liquid from the pressurized liquid source in a first direction at a rate sufficient to induce approximately longitudinal movement of the apparatus through the enclosed environment, the outlet assembly including a second outlet configured for expelling at least one of a chemical or a chemical mixed with a liquid from the pressurized liquid source in a second direction; and a chemical storage assembly, the chemical storage assembly coupled to the second flow valve outlet of the intake assembly to receive pressurized liquid from the second flow valve outlet upon application of the second pressure, the first pressure being higher than the second pressure, the chemical storage assembly being configured for at least one of (a) storing the chemical or (b) mixing the chemical with the liquid from the pressurized liquid source.

11. The system of claim 10, wherein the spray apparatus further includes:

a permeable metering hose disposed within the chemical storage assembly, the permeable metering hose coupled with the second flow valve outlet; and a fluid line coupled between the intake assembly and the outlet assembly, the fluid line configured to transfer fluid from the first flow valve outlet to the outlet assembly.

12. The system of claim 11, further including:

a check valve coupled between the fluid line and the outlet assembly, the check valve configured to direct fluid at the first pressure to the outlet assembly and configured to prevent fluid at the second pressure from entering the outlet assembly.

13. The system of claim 10, wherein the first outlet of the outlet assembly includes a plurality of nozzles configured for expelling pressurized liquid from the pressurized liquid source.

14. The system of claim 13, wherein each one of the plurality of nozzles defines an orifice having a diameter sized at least approximately the same as the other ones of the plurality of nozzles.

15. The system of claim 10, wherein the second outlet of the outlet assembly is a chemical agent nozzle, the chemical agent nozzle coupled to an eccentrically-weighted nozzle head.

16. The system of claim 10, further including a fill tube assembly including at least one inlet port configured for receiving the chemical agent, the fill tube assembly configured for receiving the chemical agent into the apparatus.

17. The system of claim 16, wherein the fill tube assembly and the outlet assembly are each configured for removable coupling to an outlet end connector via a bayonet locking system, the outlet end connector configured for coupling between the chemical storage assembly and at least one of the fill tube assembly and the outlet assembly.

18. The system of claim 17, wherein the bayonet locking system comprises the outlet end connector including a bayonet connection end and each of the fill tube assembly and the outlet assembly including a bayonet plate configured to mate with the bayonet connection end of the outlet end connector.

* * * * *